United States Patent [19]

Butcher

[11] Patent Number: 4,763,451

[45] Date of Patent: Aug. 16, 1988

[54] MODULAR BUILDING UNITS

[76] Inventor: Gary J. Butcher, No. 4, Shady Vista Rd., Rolling Hills Estate, Calif. 90274

[21] Appl. No.: 877,860

[22] Filed: Jun. 24, 1986

[51] Int. Cl.[4] ..... E04H 1/00

[52] U.S. Cl. ..... 52/79.1; 52/169.3; 52/234

[58] Field of Search ..... 52/79.1, 79.7, 234, 52/169.1, 169.2, 169.3, 79.6, 79.8

[56] References Cited

U.S. PATENT DOCUMENTS

| | | | |
|---|---|---|---|
| 2,990,588 | 7/1961 | McKinley | 52/220 X |
| 3,678,639 | 7/1972 | Panitz | 52/79.1 |
| 3,732,649 | 5/1973 | Mehran | 52/234 |
| 4,007,565 | 2/1977 | Finnegan | 52/169.3 |
| 4,222,207 | 9/1980 | Latimer et al. | 52/79.1 X |
| 4,345,407 | 8/1982 | Fishman | 52/236.3 X |
| 4,345,408 | 8/1982 | Cote | 52/169.3 |
| 4,464,877 | 8/1984 | Gebhardt et al. | 52/236.7 X |

*Primary Examiner*—Carl D. Friedman
*Assistant Examiner*—Creighton Smith
*Attorney, Agent, or Firm*—Edward E. Roberts

[57] ABSTRACT

A modular unit construction having first and second modular building units for positioning on a parcel, with each modular unit having a generally planar wall portion, the modular units being positionable on a parcel with the planar wall portions in generally parallel spaced relation, with a roof of generally identical appearance on each of said units. Further included are first and second auxiliary structures configured for attachment in contiguous relation interconnecting at said planar wall portions, with each of said generally parallel wall portions forming a sidewall of said auxiliary structures, said auxiliary structures being in abutting relation one to the other and share a common separating wall. As assembled on site, said roof means is of generally identical appearance on at least the front of the contiguous portions of each of said modular units and each of said auxiliary structures for interconnecting said units and said auxiliary structures to provide the appearance of a single one-story structure. Or in the case of dwellings, of a single residence, or duplex depending upon the design. In the case of dwellings, the auxiliary structures may be garage units.

8 Claims, 1 Drawing Sheet

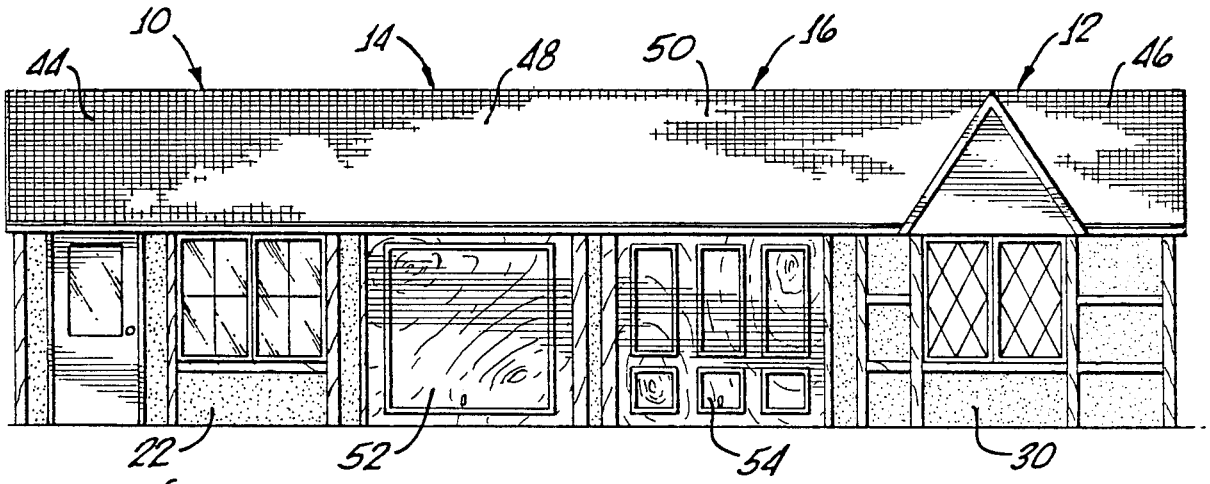
FIG. 1.
FIG. 2.
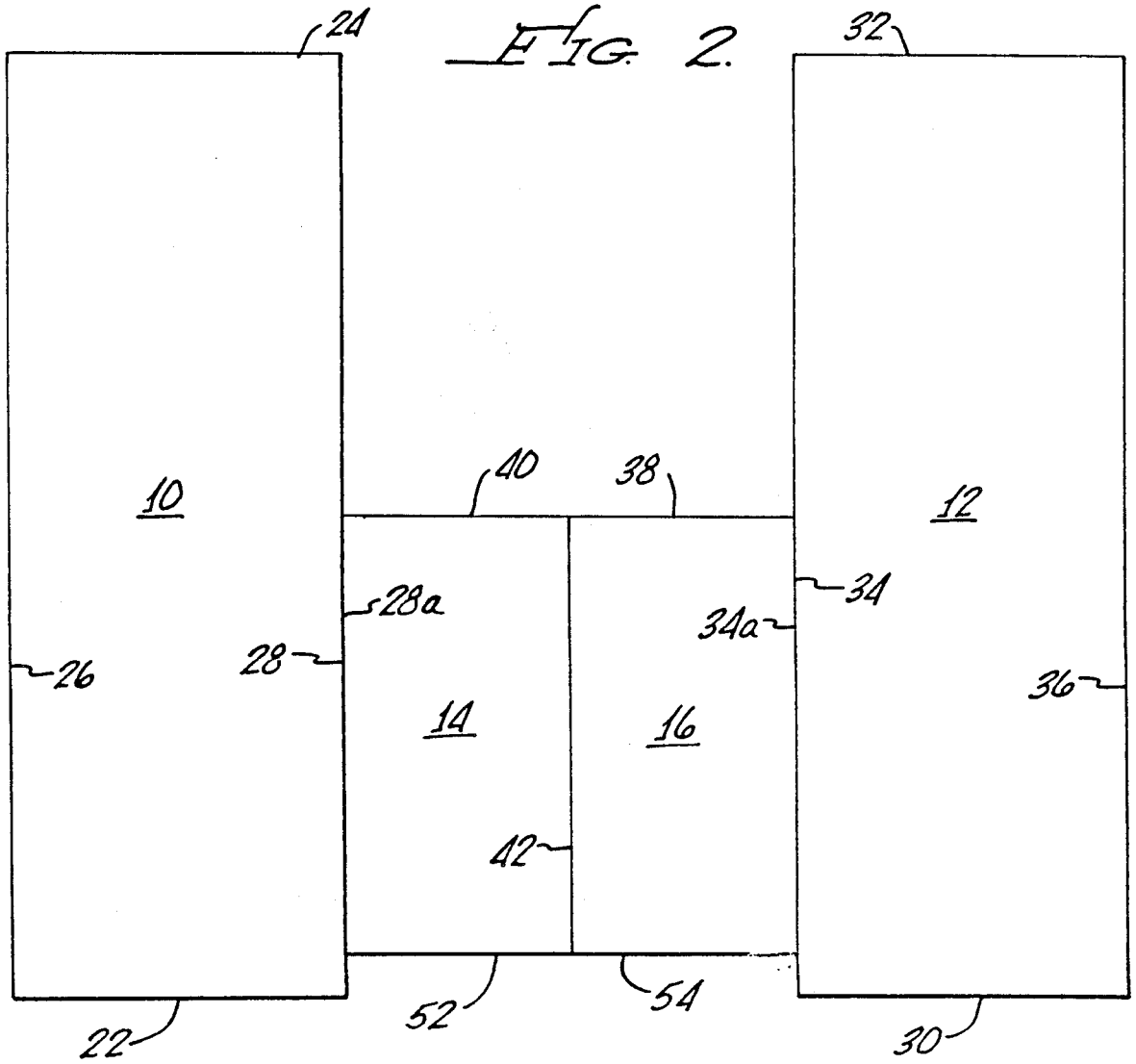

MODULAR BUILDING UNITS

BACKGROUND OF THE INVENTION

The background of the invention will be discussed in two parts:

FIELD OF THE INVENTION

This invention relates to modular unit building construction, and more particularly to a one-story modular duplex type home construction.

DESCRIPTION OF THE PRIOR ART

Modular unit building construction has been previously directed primarily at single units transportable over the nation's highways, thus necessitating that the modules from which such buildings are constructed be of a width for such transporting, or a multiple of that width. Such units are generally intended for assembly as a single building on a parcel of land, be it owned or leased. With such construction, other additives such as, in the case of dwellings, car ports may be added once the unit has been installed at the site, or a garage may be constructed. With the construction of such additions, many states have building codes that require that the adjacent wall of the unit be modified to what is termed a "one hour fire rating."

Prior art mobile or modular home construction is shown in the following U.S. design patents: U.S. Pat. No. 226,263 (Bizzaro); U.S. Pat. No. Des. 206,582 (Harper); U.S. Pat. No. Des. 268,921 Marshall); and U.S. Pat. No. Des. 243,753 (Raupp).

Other prior art is found in U.S. Pat. No. 4,007,565 to Finnegan, which relates to a land development arrangement for at least four dwelling modules having as its purpose a high building-to-land area ratio whereby a plurality of individual and spaced apart single family dwellings are disposed in a U-shaped configuration; U.S. Pat. No. 4,345,407 to Fishman which relates to floor plans for multi-unit dwellings arranged to form a courtyard with the objective to provide maximum privacy for each unit; and U.S. Pat. No. 4,464,877 to Geghardt et al, which relates to a method of assembly of multi-unit buildings employing fire resistant panels as party walls.

It is an object of the present invention to provide a new and improved modular building construction.

It is another object of the present invention to provide a new and improved duplex modular home construction.

It is a further object of the present invention to provide a new and improved duplex type modular home construction wherein two modular home units are joined together to provide the appearance of an integrated single residence with two car port type garage means, or attached garage means between the units.

SUMMARY OF THE INVENTION

The foregoing and other objects of the invention are accomplished by providing first and second modular building units for positioning on a parcel.

Each of the modular unit has a generally planar wall portion, the units being positionable with the planar wall portions in generally parallel spaced relation, with, in the case of home construction, first and second garage units configured for attachment, or a look of attachment, in contiguous relation interconnecting said spaced wall portions, with a roof of generally identical composition on each of the garage units, and on corresponding portions of each of the modular building units, said roofs of the building units in abutting rlationship and share continuous lines to present the appearance of one continuous roof, therby giving the appearance of an integrated single building, or in the case of home construction, of a single residence or duplex.

Other objects, features and advantages of the invention will become apparent from a reading of the specification when taken in conjunction with the drawings, in which like reference numerals refer to like elements in the several views.

BRIEF DESCRIPTION OF THE DRAWINGS

FIG. 1 is a front elevational view of a duplex modular home construction according to the invention; and FIG. 2 is a diagrammatic top plan view of the duplex modular home construction of FIG. 1.

DESCRIPTION OF THE PREFERRED EMBODIMENT

Referring now to the drawings, and particularly to FIG. 1, there is shown a front view of a duplex modular home construction according to the invention, such construction including first and second modular units generally designated 10 and 12 positioned on a site (See also FIG. 2), with first and second garage units generally designated 14 and 16 interconnecting, or appearing to interconnect, the two units 10 and 12.

As illustrated in FIG. 2, each of the units 10 and 12 is shown, but need not be, as basically rectangular in configuration. For example unit 10 has front and rear walls 22 and 24, respectively, and parallel opposing side walls 26 and 28, respectively. Similarly, the modular unit 12 has front and rear wall 30 and 32, respectively, and opposing parallel side walls 34 and 36, respectively.

A portion of each of the facing side walls 28 and 34 of units 10 and 12 is designated with a suffix, such as **28*a* and 34*a*, these wall portions being in spaced generally parallel facing relation, and specially constructed to resist fire at a "fire rating" consistent with appropriate building standards. The wall portions 28*a* and 34*a* are configured and constructed for forming the sidewall of the adjacent garage means or unit 14 and 16**, respectively.

As depicted in FIG. 2, the garage units 14 and 16 are free standing and interconnect, or appear to interconnect, the modular units 10 and 12, and may be readily constructed on site by the addition of the unit front and unit rear walls (or posts) 38 and 40, respectively, along with a separating partition or wall 42, (along with required fire walls) which effectively forms the two separate garage units 14 and 16.

Referring again to FIG. 1, the two modular units 10 and 12 are constructed at the factory with roofs 44 and 46 of generally identical appearance and composition, with the roofs 48 and 50 of the garage units 14 and 16, respectively, having the same appearance to produce a continuous, one to the other, uniform effect. The modular units are preferably erected and connected on site such that the roofs are in abutting relationship and share generally continuous lines to present the appearance of one continuous roof.

As shown in FIG. 1, the modular units 10 and 12 need not be identical in exterior appearance, but should have architectural similarity. For example, the unit 10 has a front entrance, while unit 12 is configured for a side entrance. The garage doors 52 and 54 also need not be identical.

In accordance with the present invention, two modular units 10 and 12 may be assembled at the factory for site installation, with garage wall portions 28*a* and 34*a* in spaced generally parallel relation with garage units 14 and 16 constructed on site with roofing compositions generally similar to the roofing composition of the modular units 10 and 12 so as when assembled on site to give the appearance of one continuous single roof. Garage units 14 and 16 are shown in contiguous abutting relation, however, this is not mandatory, since these units may be offset from one another. In addition, although the garage units are shown as single vehicle units, either or both garage units may be configured for multiple vehicle storage.

Furthermore, the modular units 10 and 12 need not be rectangular, but may be L-shaped within the scope of the invention, and in addition, the roofing composition need not be the same or even similar for the entire roof structure. For example, in some structures, only the portion of the roof visible from the front of the unit may have the same appearance, such as tile or shake, with the balance of the roof being of a different appearance/-composition, such as a tar paper composition, or tar paper and rock construction. However, in the preferred embodiment, the roofs of the two units are in abutting relationship and share generally continuous lines to present the appearance of one continuous roof, and thereby provide the appearance, from at least the front, of an integrated single building, or in the case of a residence, the appearance of a single story home or duplex, depending upon the design.

While there has been shown and described a preferred embodiment, it is to be understood that other adaptations and modifications may be made within the spirit and scope of the invention.

I claim:

1. A construction for modular building units comprising:

first and second modular one-story units each having a front wall, a rear wall, and opposing sidewalls, with one of said sidewalls having a generally planar wall portion, said first and second units being positionable on a parcel with said front walls in general alignment and with said generally planar wall portions in opposing generally parallel spaced relation and configured for attachment of said first and second units with said planar wall portions in spaced relationship;

roof means of generally identical appearance on at least the front of the contiguous portions of each of said modular units whereby the interconnecting of said units provides the appearance of a single one-story structure having continuous appearing roof lines;

first and second auxiliary structures configured for attachment in contiguous relation interconnecting at said planar wall portions, with each of said generally parallel wall portions forming a sidewall of said auxiliary structures;

said auxiliary structures are in abutting relation one to the other with the fronts thereof in general alignment and share a common separating wall; and said roof means is of generally identical appearance on at least the front of the contiguous portions of each of said modular units and each of said auxiliary structures for interconnecting said units and said auxiliary structures to provide the appearance of a single one-story structure.

2. The combination according to claim 1 wherein said first and second modular one-story units are generally rectangular.

3. A construction for modular dwelling units comprising:

first and second modular one-story home units for positioining on a parcel, said first modular home unit having a front wall, a rear wall and opposing sidewalls, one of said sidewalls having a generally planar wall portion, with said second modular home unit having a front wall, a rear wall and opposing sidewalls, one of said sidewalls having a generally planar wall portion of dimensions generally equal to the dimensions of said planar wall portion of said first home unit, said first and second units being positionable on said parcel with said generally planar wall portions in opposing generally parallel spaced relation and with said front walls in general alignment;

first and second garage means configured for attachment to said modular home units in contiguous relation interconnecting said spaced wall portions, with each of said generally parallel wall portions forming a sidewall of said garage means and with the fronts of said garage means in general alignment; and roof means of generally identical appearance on at least the front of the contiguous portions of each of said modular home units and each of said garage means for interconnecting said units and said garage means to provide the appearance of a single one-story structure.

4. The combination according to claim 3 wherein each of said garage means is in abutting relation to the other and share a common separating wall.

5. The combination according to claim 1 wherein said roof means of each of said modular units are in abutting relationship and share generally continuous lines to present the appearance of one continuous roof.

6. The combination according to claim 4 wherein the front wall means of each of said garage means are generally co-planar.

7. The combination according to claim 6 wherein said first and second modular one-story home units are generally rectangular.

8. A construction for modular dwelling units comprising:

first and second modular one-story home units for positioning on a parcel, each of said first and second modular home units having generally identical rectangular configurations with a front wall, a rear wall and opposing sidewalls with one of said sidewalls having a generally planar wall portion, said first and second units being positionable on said parcel with said front walls in generally coplanar relationship and with said generally planar wall portions in opposing generally parallel spaced relation;

first and second garage units configured for attachment to said modular home units with said garage units in contiguous relation with the fronts thereon in general alignment and with said garage units interconnecting said spaced wall portions, with each of said generally parallel wall portions forming a sidewall of said garage units; and roof means of generally identical appearance on at least the front of the contiguous portions of each of said modular home units and each of said garage units, the roof means of each of said home units and garage units being in generally continuous abutting relationship for interconnecting said home units and said garage units to provide the appearance of a single one-story structure.

* * * * *